United States Patent [19]

Kowatsch et al.

[11] Patent Number: 4,889,359

[45] Date of Patent: Dec. 26, 1989

[54] LATERALLY RELEASABLE JAW UNIT OF A SAFETY SKI BINDING

[75] Inventors: Ulrich Kowatsch, Leonberg; Heike Bauer, Welzheim, both of Fed. Rep. of Germany

[73] Assignee: GEZE Sport International GmbH, Fed. Rep. of Germany

[21] Appl. No.: 206,590

[22] Filed: Jun. 14, 1988

[30] Foreign Application Priority Data

Jun. 19, 1987 [DE] Fed. Rep. of Germany ..... 3720440

[51] Int. Cl.[4] ..... A63C 9/085

[52] U.S. Cl. ..... 280/629; 280/634; 280/636

[58] Field of Search ..... 280/623, 625, 626, 627, 280/628, 629, 630, 634, 636

[56] References Cited

U.S. PATENT DOCUMENTS

| | | | |
|---|---|---|---|
| 4,027,897 | 6/1977 | Hildebrand | 280/625 X |
| 4,060,257 | 11/1977 | Jungkind et al. | 280/626 |
| 4,337,965 | 7/1982 | Salomon | 280/628 |
| 4,365,822 | 12/1982 | Nitschko et al. | 280/625 |
| 4,516,792 | 5/1985 | Scheck et al. | 280/628 X |
| 4,593,928 | 6/1986 | Scheck et al. | 280/625 |

FOREIGN PATENT DOCUMENTS

| | | | |
|---|---|---|---|
| 3717788 | 1/1988 | Fed. Rep. of Germany | 280/626 |
| 2537442 | 6/1984 | France . | |

*Primary Examiner*—Charles A. Marmor
*Assistant Examiner*—Tamara L. Finlay

[57] ABSTRACT

A laterally releasable toe unit of a safety ski binding has a sole clamp (18) which is pivotable about substantially vertical tilting axes (16) provided on the binding housing (11) and is pressed by a release spring (12) against tilting surfaces defining the tilting axes (16). The angle $\alpha$ between the line of action (19) of the release spring (12) and the tilting axis (16) is smaller than 90°, so that a force N is exerted on the sole clamp (18) by the release spring which draws it downwardly.

22 Claims, 3 Drawing Sheets

LATERALLY RELEASABLE JAW UNIT OF A SAFETY SKI BINDING

BACKGROUND OF THE INVENTION

The invention relates to a laterally releasable jaw unit, in particular to the toe unit of a safety ski binding and has particular reference to a ski binding which also has a jaw which holds the other end of the ski boot, in particular a heel jaw which preferably also exerts a resilient thrust force in the longitudinal direction of the ski on the laterally releasable jaw unit via the ski boot.

One known form of toe unit comprises a binding housing, a sole clamp having two lateral limbs and a hold-down clamp disposed on the housing adjacent the ski boot and a release spring disposed in the binding housing substantially in the longitudinal direction of the ski. The release spring acts at one end on the binding housing and exerts via its other end a force on the sole clamp, the force having a substantial component in the longitudinal direction of the ski and in the direction away from the ski boot. Tilting surfaces are arranged at the side of the binding housing facing the ski boot on both sides of the vertical central longitudinal plane, with the tilting surfaces having mutually parallel, straight tilting axes standing substantially upright from the surface of the ski. Complementary tilting counter-surfaces provided on the side of the sole clamp facing away from the ski boot act on the tilting surfaces under the action of the release force in such a way that with excessive lateral forces on the ski boot the sole clamp pivots outwardly against the force of the release spring and releases the ski boot.

A releasable toe unit for ski bindings is already known (AT-PS 300 630) in which a sole hold-down clamp is arranged on a laterally releasable toe unit, with the sole hold-down clamp being able to deviate resiliently upwardly against the bias of a spring. This is intended to prevent the boot exerting abnormal loads on the binding and on the ski, and thus changing the functional characteristics of the binding, for example when a layer of snow is present between the boot and the ski. The disadvantage of this known ski binding is the requirement for a special hold-down spring.

It is also already known (DE-OS 32 30 186) to derive the resilient hold-down force acting on the sole hold-down clamp from the release spring extending in the longitudinal direction of the ski. However, for this it is necessary to allow the one end of the release spring to act on the sole hold-down clamp and for the other end of the release spring to act on the sideways release mechanism. For this purpose the front end of the release spring must also be movable together with the components which support it and this is a disadvantage both from the point of view of the construction and also of the operation.

In accordance with an older proposal (DE-OS 36 05 313) provision is made for the sole hold-down clamp, the side jaws, the sideways release mechanism and the point of action of the release spring on the sideways release mechanism to be arranged on a carrier part which is pivotable upwardly relative to the binding housing about a transverse axle. The transverse axle is located at a distance above the line of action of the release spring such that a predetermined, resiliently yielding hold-down force originating from the release spring acts from the top side on the sole of the ski boot. In this way a torque is generated by the release spring about the transverse axle which tries to move the sole hold-down clamp downwardly. As a result of this construction one avoids not only the disadvantages brought by a layer of snow between the sole of the boot and the ski, in particular a jamming of the shoe sole, but it is also possible to achieve a restricted degree of friction compensation. If the skier should enter into a rearward position then the friction on the sole hold-down clamp admittedly increases somewhat, however the friction at the sole plate simultaneously reduces significantly so that the sideways release is not made more difficult, but if anything is made easier, which is entirely desirable in the event of a rearward fall. A disadvantage of this previously known safety ski binding lies in the fact that it is necessary to provide a housing which is pivotable about a transverse axle which brings increased manufacturing complexity and expense.

The principal object underlying the invention is thus to so further develop a laterally releasable jaw unit with a sole clamp which is pivotally laterally about tilting axes, for example as is known from DE-PS 31 29 536, so that with hardly any increase in construction or complexity one automatically prevents the sole of the ski boot from becoming jammed too hard between the hold-down clamp of the sole clamp and the ski surface, or a footplate arranged thereon, and so that in the rear position of the skier the sideways release process is made somewhat easier.

SUMMARY OF THE INVENTION

In order to satisfy this object the present invention provides that the release spring exerts a slightly downwardly directed force on the sole clamp; and that an angle is present between the line of action of the release spring and the branch of each tilt axis lying beneath this line of action, with the angle being smaller than 90° by an amount such that the force component which thereby acts downwardly on the sole clamp is able to press the sole clamp downwardly along the tilting axes until the hold-down clamp presses against the upper side of the sole of the ski boot, at least during the vibrations which occur during skiing.

The basic concept underlying the invention is thus to exploit the tilting surfaces or tilting edges which are already necessary for sideways release additionally as upward and downward sliding surfaces for the sole clamp, for which purpose it is only necessary to provide a certain free space for the displacement of the sole clamp and also for the release force transmission elements which act on it and to provide the angle defined above between the tilting axes and the line of action of the release spring. On inserting a ski boot sole which is somewhat thicker the sole clamp is displaced somewhat upwardly along the tilting axes whereas on subsequently inserting a thinner shoe sole the downwardly acting force components of the release spring displaces the sole clamp along the tilting axes downwardly until the hold-down clamp is lightly pressed from above against the sole of the ski boot. The sole of the ski boot is thus clamped in pincer-like manner between the treading plate on the ski surface and the hold-down clamp of the sole clamp, with the vertical clamping force being delivered by the release spring. It is important that a free space is present in front of the treading plate and beneath the hold-down clamp of the sole clamp such that any shape or size of ski boot sole which may be encountered can be inserted from above beneath the hold-down clamp.

If the skier moves into a rearward position when using the jaw unit of the invention as a toe unit then the sole of the boot can displace the sole clamp somewhat upwardly along the tilting axes. The sole of the boot lifts somewhat from the top surface of the ski away from the treading plate during this so that the lateral friction which would otherwise be present there is avoided, and the lateral release process is made easier in the desired manner.

The angle between the line of action of the release spring and the tilting axes can be realised in practice by directing it obliquely downwardly away from the ski boot. Alternatively, the tilting axes can be inclined in such a way that their upper region is closer to the ski boot than if they were arranged perpendicular to the ski surface. Both these measures are expediently combined to avoid a too pronounced inclined position of the line of action of the release spring and of the tilting axes, so that both measures contribute to approximately the same degree to the desired effect.

The aforementioned angle expediently lies in the range from 70° to 80° and in particular amounts to approximately 75°.

The release spring is preferably a compression spring which is braced at one end against an abutment fixed relative to the housing and provided between it and the sole clamp; and conveniently acts on the sole clamp via a draw bar attached to its other end. This arrangement is of particular advantage as it results in a particularly compact construction.

The draw bar is expediently secured to an abutment which accommodates the end of the spring remote from the sole clamp.

Moreover, an indicator projection expediently extends from the end of the spring remote from the sole clamp substantially parallel to the line of action beneath a window at the binding housing provided with a scale for the release hardness.

This indicator projection has the especial advantage that on inserting a somewhat thicker boot sole into the jaw unit which results in greater bias of the release spring, the indicator projection is simultaneously displaced so that the greater release force required by the insertion of the thicker boot sole is indicated. The desired release value can thus be set again by adjustment of the bias of the release spring.

Adjustability of the bias of the release spring is realized in simple manner by an arrangement in which the draw bar consists of two parts which are axially screwed together, of which one is rotationally fixedly mounted on the sole clamp and the other is rotatably mounted at the end of the spring or to the abutment remote from the sole clamp and is accessible from the outside for the purpose of rotary actuation.

It is particularly advantageous when the release spring acts on the sole clamp on a central pivot shaft which extends parallel to the tilting axes and is non-displaceable in the direction of the pivot shaft, but is pivotable relative to the sole clamp and about the axis of the pivot shaft. The pivot shaft is preferably rotatable relative to the sole clamp whereby relative rotation between the spring end which acts on the sole clamp and the sole clamp is made possible in simple manner.

With this embodiment the draw rod preferably acts on an inclined surface of the pivot shaft which extends perpendicular to the axis of the draw bar. This ensures that the force of the release spring acts on the sole clamp as perpendicularly as possible.

It is particularly advantageous when the sole clamp is divided into two halves symmetrically to the vertical central longitudinal plane, with each half being respectively rotatably connected with the pivot shaft via vertically displaced projections which cross the central longitudinal plane. This measure is known per se from DE-PS 31 29 536. The support of the ski boot in such a way that the sole clamp has at least two front support positions located to the side of the central longitudinal plane, and at least two support locations which support the obliquely forwardly extending region of the sole at the side obliquely from the front, is also basically known from the previously named patent specification. In conjunction with the present invention this support however has the advantage that the increased bias of the release spring is automatically indicated by the indicating projection on inserting a ski boot with a broader sole, so that in this case a correction of the adjustment of the release hardness is possible without problem.

A particularly advantageous further development of the invention is characterised in that a vertical tilting abutment is provided on the binding housing above the line of action of the release spring and cooperates with a vertical tilting counter-surface on the sole clamp in such a way that on the occurrence of a specific vertical force acting from the sole of the ski boot on the hold-down clamp the sole clamp first slides upwardly along the tilting axes until the vertical tilting counter-surfaces abut against the vertical tilting abutment; and in that on further increase of the vertical force to a value which is dangerous for the skier the sole clamp can pivot upwardly to release the ski boot about the vertical tilting abutment, i.e. pivots about a transverse axis located at the level of the vertical tilting abutment. Thus, vertical release of the jaw unit is ensured in addition to the sideways release in a constructionally extremely simple manner. The only constructional measures required for this lie in the suitable arrangement of the vertical tilting abutment and also the vertical tilting counter-surfaces and the free spaces arranged therebetween.

At least two vertical tilting counter-surfaces are preferably provided and are selectively positionable at different levels below the vertical tilting abutment. This can be achieved by an arrangement in which a fixed vertical tilting counter-surface is provided on the sole clamp and a second vertical tilting counter-surface is provided on a slider which is preferably horizontally displaceable, with the slider being slidable over the first vertical tilting counter-surface. The measures also make it possible to obtain different release hardnesses during vertical release. When the vertical tilting counter-surface lies somewhat closer to the vertical tilting abutment a greater vertical release hardness is obtained, which can for example be of advantage when the safety ski binding is used by a racer.

In any event a pedal should be provided in the toe unit of the invention beneath the sole of the ski boot near to the sole clamp and should carry a low friction layer.

The pedal is preferably vertically movable and acts via a force deflecting transmission on the sole clamp vertically from below in such a way that when the skier is in the forward position the sole clamp is pressed upwardly along the tilting axes so far that the vertical clamp at least substantially no longer presses on the upper side of the sole of the ski boot. This makes it possible to obtain friction compensation even in a forward position of the skier, which is associated with an increased pressure from above on the pedal, in such a way that the hold-down clamp of the sole clamp is lifted from the upper side of the sole whereby the friction which would otherwise be present there is caused to disappear during sideways release. It is now only the friction between the sole of the ski boot and the pressure plate which is active. It is important that the friction compensation is not obtained by partial compensation of the release force but rather solely by vertical displacement of the sole clamp at the tilting surfaces.

The pedal is advantageously designed so that it is resiliently and elastically laterally restrictedly displaceable, with the resetting force exerted on the sole clamp during deflection up to the maximum displacement path of the pedal being reduced sufficiently that the sum of this resetting force and friction force between the sole and the pedal is already substantially less than the release force. Moreover, an emergency treading surface of low friction material is preferably provided before and/or behind the pedal and is set downwardly somewhat below it. These embodiments can also be used independently of the toe unit of the invention, should however only be used by those laterally releasable jaw units in which, after exhausting the lateral rate of displacement of the pedal, the resetting force which acts on the jaw unit has already been reduced so far that the sum of the remaining resetting force and the frictional force is considerably lower than the release value.

The so formed pedal offers the skier triple safety. The low friction layer consisting preferably of Teflon provides safety in the event that the lateral displaceability of the pedal should fail by being frozen solid or through corrosion. In that case the comparatively low friction between the low friction layer and the sole of the boot remains.

Should the displaceable pedal fall out of its mount and be lost then the emergency treading surface still provides the required low friction support. It is of particular importance that the emergency treading surface need not consist of a very wear-resistant low friction material since it is normally not used and need only satisfy its function for a relatively short period of time in the event of loss of the laterally displaceable pedal.

BRIEF DESCRIPTION OF THE DRAWING

The invention will now be described in the following by way of example and with reference to the drawings, in which.

DESCRIPTION OF PREFERRED EMBODIMENTS

Figure 1:
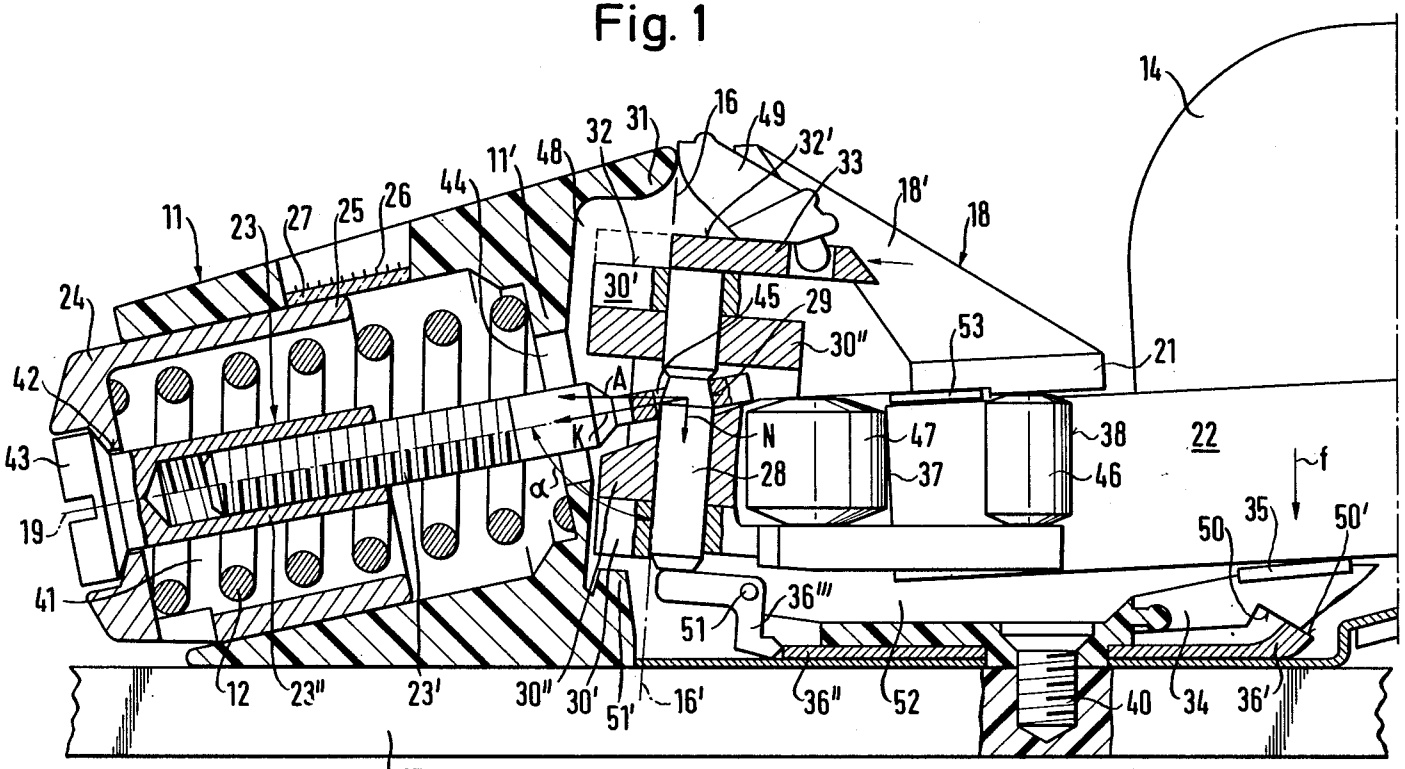
FIG. 1 is a partly sectioned side view along line II—II of FIG. 2, of a toe unit of a safety ski binding in accordance with the invention and with an inserted ski boot.
Figure 2:
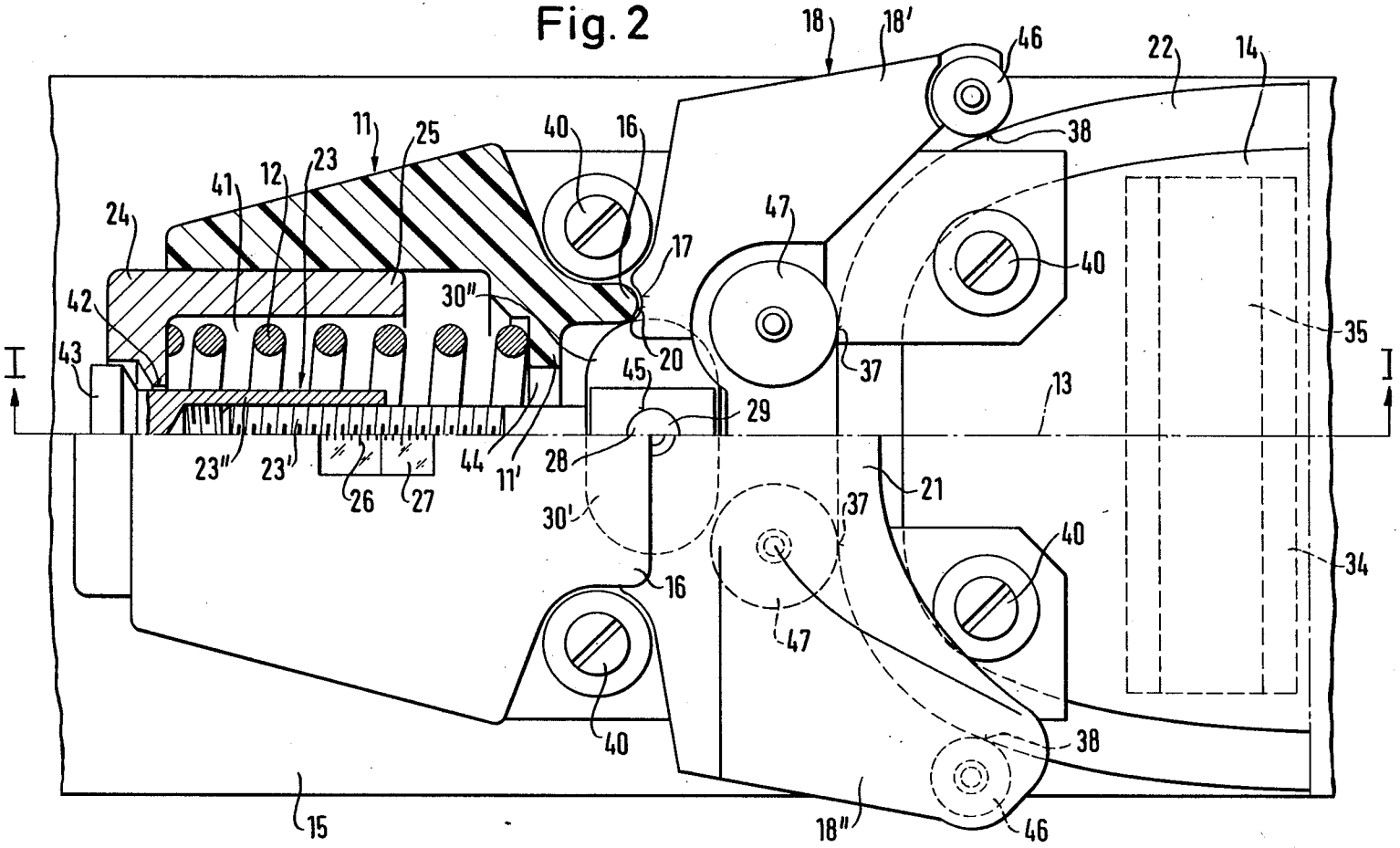
FIG. 2 is a partly sectioned plan view of FIG. 1.

In accordance with FIGS. 1 and 2 a binding housing 11 is secured to the surface of the ski 15 by means of screws 40. The binding housing has an approximately cylindrical recess 41 which extends substantially in the longitudinal direction of the ski at the side remote from the ski boot 14 to accommodate a release spring 12. The release spring 12 is supported at the boot side against a radially inwardly projecting ring abutment 11' and extends from there obliquely downwardly and forwardly into a hollow cylindrical shell-like abutment 24 which can slide axially in piston-like manner within the recess 41. The abutment 24 has an axial indicator projection 25, the end of which facing the ski boot 14, is arranged beneath a window 27 in the upper side of the binding housing 11, with the window 27 being provided with a release hardness scale 26, i.e. a scale for the release setting of the binding.

A draw bar 23 with a head 43, for example a head rotatable by a screw driver, extends coaxially to the release spring 12 in a central bore 42 in the front region of the abutment 24. The draw bar 23 consists of a part 23'' which is connected to the head 43 and has an axial threaded bore into which a second part 23' formed as a threaded bar is screwed from the side of the ski boot 14. The part 23' extends through an opening 44 inside the abutment 11', with clear play on all sides, to a pivot shaft 28 which is tilted slightly rearwardly but which is substantially vertical and which is surrounded by a bore 45 in the end of the part 23', and indeed in the region of an annular recess which has a conical inclined surface 29. The cone angle at the side facing the ski boot 14 corresponds to the angle between the axis of the draw bar 23, i.e. the line of action 19 of the release spring 12, and the axis of the pivot shaft 28. In this manner the force of the release spring 12 acts perpendicular to the inclined surface 29.

In accordance with FIGS. 1 and 2 the two halves 18', 18'' of a sole clamp 18 are pivotally arranged at the pivot shaft 28, which is non-rotatable relative to the draw bar 23. For this purpose the two sole clamp halves 18', 18'' each have projections 30', 30'' which extend beyond the vertical central longitudinal plane 13, with the projections being vertically displaced relative to one another in the manner which can be seen from FIG. 1 and being in rotary engagement with the pivot shaft 28. Thus, the sole clamp 18 is fixed, i.e. non-displaceable relative to the pivot shaft 28 in the vertical direction.

In accordance with FIGS. 1 and 2 tilting surfaces 20 are provided on both sides of the vertical central longitudinal plane 13 at the side of the binding housing facing the ski boot 14 and define tilting axes 16 which stand substantially upright on the ski surface. The tilting surfaces 20 are identically constructed and symmetrical to the central longitudinal plane 13. Complementary tilting counter-surfaces 17 of the two halves 18', 18'' of the sole clamp 18 cooperate with these tilting surfaces 20 and they are brought into contact therewith by the release spring 12. On the sole clamp there is a hold-down clamp 21 which lies on the sole 22 of the ski boot 14 from above. Moreover the sole clamp has two lateral limbs on which lateral rollers 46 are arranged which define lateral support points 38 for the sole of the boot.

The sole clamp 18 is arranged with its front regions in a free space 48 of the binding housing 11 in such a way that it can be displaced relative to the tilting axes 16 in the vertical direction within a range such that all the varying thicknesses of the sole 22 which are encountered can be clamped by the sole clamp 18. The draw bar 23 also has a corresponding vertical play within the opening 44 of the abutment 11'. The head 43 must also have corresponding room for movement within the abutment 24.

At the top the free space 48 is closed off by a vertical tilting abutment 31 which is fixedly connected with the binding housing 11. Beneath this vertical tilting abutment 31 there is located a substantially horizontal vertical tilting counter-surface 32 of the sole clamp 18. A slider 33 arranged on the upper side of the sole clamp 18 can be slid over this vertical tilting counter-surface 32 with the upper surface of the slider 33 defining a second vertical tilting counter-surface 32' which is disposed somewhat higher. When the lower vertical tilting counter-surface 32 is to be effective then the slider 33 is located in the position which can be seen from FIG. 1 in which it projects outwardly from the boot side surface of the sole clamp 18. It can be actuated from there in the direction of the arrow in FIG. 1 in order to then reach the position shown in broken lines in FIG. 1. In this broken line position the upper vertical tilting counter-surface 32' takes on the function of the previously effective vertical tilting counter-surface 32. An actuating member 49 which projects outwardly on the toe unit at the top between the vertical tilting abutment 31 and the sole clamp 18, and which engages at the bottom with the slider 33, makes it possible for the skier to move the slider 33 out of the broken line position shown in FIG. 1 into the full line position shown in FIG. 1, i.e. towards the ski boot 14, through pressure exerted from above on the actuating member 49. In the full line position the lower vertical tilting counter-surface 32 cooperates with the vertical tilting abutment 31.

A pedal 34 which is provided with a low friction layer 35 is located in the front region of the sole 22 and acts via wedge surfaces 50, 50' which are arranged thereon on a wedge 36' which is displaceable in the longitudinal direction of the ski. The wedge 36' acts via a push rod 36'', which is located close to the surface of the ski and is displaceable in the longitudinal direction of the ski, on a cranked lever 6''' which is pivotable about a transverse axis 51. The essentially vertically downwardly extending arm of the cranked lever 36''' is loaded by the push rod 36'' in the longitudinal direction of the ski. The other substantially horizontally extending arm of the cranked lever 36''' engages on the pivot shaft 28 from below. By exerting pressure downwardly on the pedal 34 in the direction of the arrow f a thrust force is exerted forwardly on the push rod 36' via the wedge surfaces 50, 50' and this pressure pivots the cranked lever 36''' in the clock-wise sense so that the sole clamp 18 is displaced upwardly along the tilting surfaces 20.

The manner of operation of te toe unit as described is as follows:

As a result of the inclined position of the line of action 19 of the release spring 12, and also of the inclination of the pivot shaft 28 in such a way that its upper end is closer to the ski boot 14 than if it were arranged perpendicular to the surface of the ski 15, the draw bar 23 acts in the manner shown in FIG. 1 obliquely on the pivot shaft 28. The force K exerted by the draw rod 23 as a result of the action of the release spring 12 on the pivot shaft 28 in the direction of the line of action 19 is thus resolved into a forwardly directed horizontal component A, which determines the release force and a vertically downwardly directed, relatively small, component N. The size of the force component N in relationship to the force component A depends on the angle $\alpha$ which the lower branch 16' of the tilt axes 16 includes with the line of action 19 as seen in the sideview of FIG. 1. In the illustrated embodiment this angle $\alpha=75°$.

The vertically downwardly directed force component N attempts to draw the sole clamp 18 downwardly along the tilting surfaces 20 (of FIG. 2). The tilting surfaces 17, 20 expediently consist of low friction material so that the force component N can overcome the friction between the tilting surfaces 17, 20.

Without an inserted ski boot the sole clamp 18 is thus located in its lowest position which can, for example, be determined by an abutment 51' arranged beneath the sole clamp.

If a ski boot 14 is inserted into the so formed binding then the front region of the sole 22 is inserted obliquely from above into the gap between the hold-down clamp 21 and the pedal 34. The free space 52 present beneath the hold-down clamp 21 ensures that the ski boot can be inserted in this manner without too much resistance so that the sole 22 can be inserted beneath the hold-down clamp 21 until it abuts against the front support rollers 47. In so doing the side edges of the sole 22 contact the lateral support rollers 46 and spread the two halves 18', 18'' of the sole clamp 18 sufficiently far that the front surface of the sole 22 just contacts the front support rollers 47.

The non-illustrated heel of the ski boot 14 is subsequently lowered downwardly, whereupon the underside of the sole 22 comes into contact with the pedal 34 and the upper front edge of the sole 22 lifts the hold-down clamp 21 as far as necessary, with the sole clamp 18 sliding upwardly somewhat as a whole along the tilt axes 16.

The release spring 12 is pretensioned to a somewhat greater degree both during spreading apart of the halves 18', 18'' of the sole clamp 18 and also during the vertical sliding movement of the sole clamp 18 on the tilting surfaces 20, with the indicator projection 25 being displaced somewhat to the right in FIG. 1 relative to the release hardness scale 26. The somewhat increased release hardness is thus indicated and can be reduced again by corresponding rotation of the screw head 43.

As a result of the construction of the invention the sole 22 of the ski boot 14 is clamped in plier-like manner between the hold-down clamp 21 and the pedal 34, with the plier force being delivered by the force component N which originates from the release spring 12.

The lateral release can now take place in the manner usual in such a tilting jaw unit by pivoting about one of the tilting axes 16. The release force is determined by the force component A.

If the skier enters into a rearward position then the sole 22 can displace the sole clamp 18 upwardly via the hold-down clamp 21, and the pressure of the sole 22 on the pedal 34 is removed.

As soon as the vertical tilting surface 32 reaches the vertical tilting abutment 31 the sole clamp 18 can pivot upwardly about a transverse axis provided at the vertical tilting abutment 31 and release the ski boot 14.

If the slider 33 is displaced prior to using the binding in the direction of the arrow into the position shown in broken lines then the vertical tilting counter-surface abuts even for a small upward vertical displacement of the sole clamp 18 against the vertical tilting abutment 31, which leads to a greater vertical release hardness as a result of the larger lever arm that is now present.

In a forward position of the skier the sole 22 of the boot presses downwardly in the direction of arrow f on the pedal 34 whereby the push rod 36'' is pushed forwardly via the wedge surfaces 50, 50' and the wedge 36. This leads, via the cranked lever 36''', to a displacement of the sole clamp 18 upwardly along the tilting axis 16. In this way the pressure of the hold-down clamp on the sole 22 from above disappears so that the friction which is normally present there also disappears, and now it is only the friction between the sole 22 and the lining 35 of the pedal 34 which is still present. In this way a constant and indeed reduced lateral release force is ensured, so that in the case of a combined forward rotating fall a preferably easier sideways release of the binding takes place.

In order to keep the friction between the hold-down clamp 21 and the upper side of the sole clamp too low, a friction reducing lining 53 preferably of teflon is likewise provided beneath the hold-down clamp 21. When the slider 33 is displaced to the position shown in FIG. 1 in broken lines the actuating lever 49 projects upwardly beyond the binding housing 11. It can now be displaced downwardly again into the position shown in FIG. 1 by pressure exerted with the finger or with the ski stick, with the slider 33 being displaced into the position close to the boot illustrated in full lines in FIG. 1, and the vertical tilting counter-surface 32 again comes into action.

Figure 3:
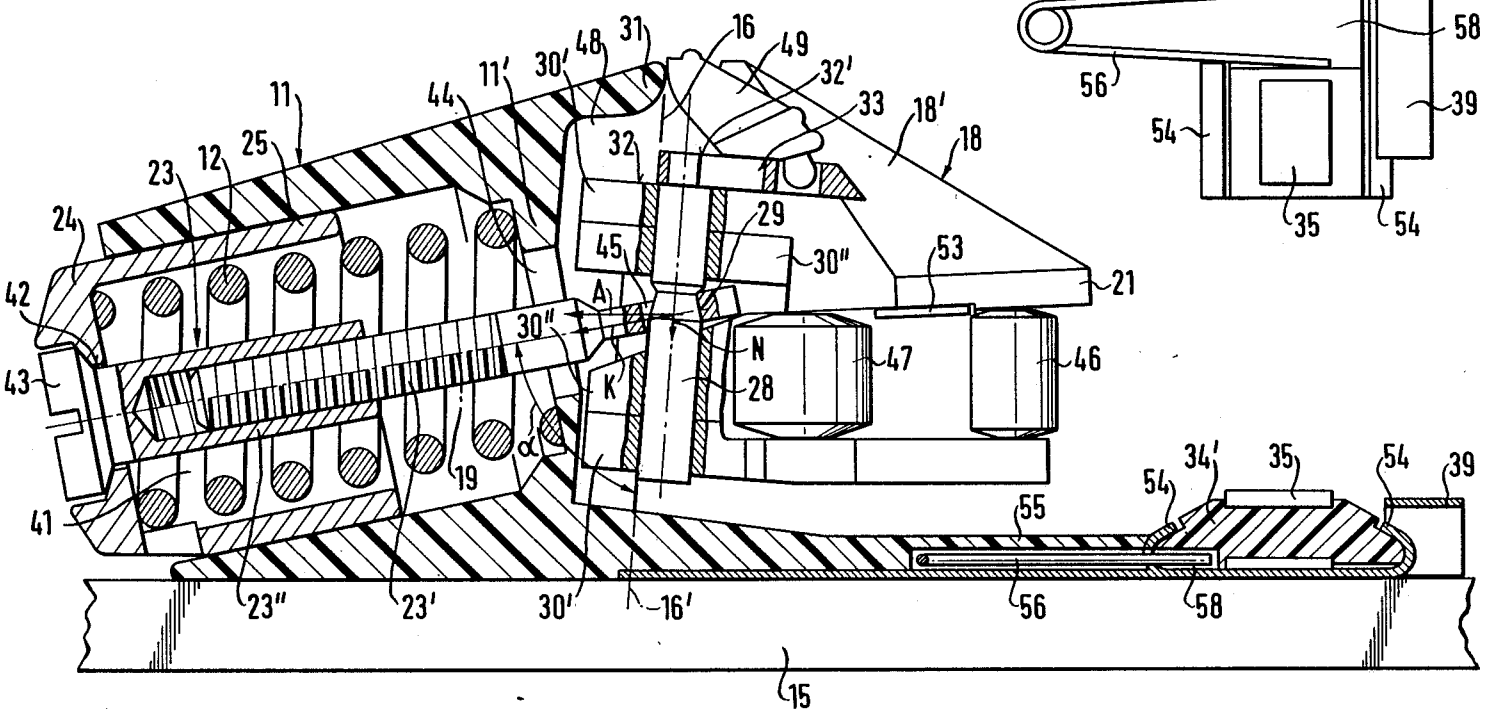
FIG. 3 is a partly sectioned side view of a further embodiment of a toe unit in accordance with the invention.

In the embodiment of FIG. 3 the same reference numerals are used to designate parts which have counter-parts in the preceding embodiments.

Figure 4:
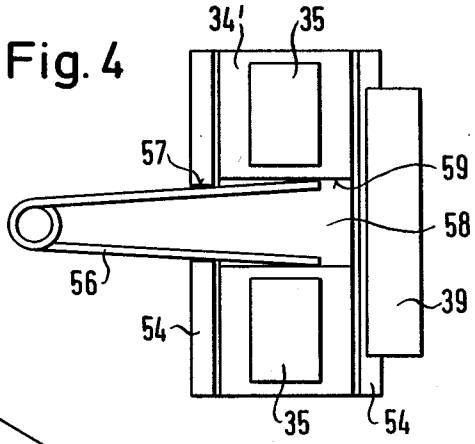
FIG. 4 is a plan view of the pedal of the embodiment of FIG. 3.

The construction and function of the embodiment of FIG. 3 are the same as for the embodiment of FIGS. 1 and 2 apart from the friction compensator with the force deflecting transmission 36', 36'', 36'''. In the embodiment of FIGS. 3 and 4 the pedal 34' is mounted transversely displaceable in a guide 54 on the surface of the ski. At the center of the pedal a spreading spring 56 mounted on the surface of the ski beneath a cover plate 55 acts in the longitudinal direction of the ski through a restricted slide opening 57 in a lower recess 58 of the pedal 34' which is however restricted at the sides by abutments 59 in the manner which can be seen from FIG. 4. As the safety pin-shaped spreading spring 56 contacts the edges of the slot 57 and simultaneously the side abutments 59 of the pedal 34' in the rest position shown in FIG. 4, the pedal 34' is located in a stable central position. It can however be displaced to both sides against the relatively low resetting forces of the spreading spring 56 within the freedom of movement of the spreading spring 56.

The lateral displacement range for the pedal 34' is so dimensioned that during sideways release the end of the displacement region of the pedal 34' is first reached when the resetting force exerted on the sole clamp 18 by the release spring 12 has already been reduced to such a level that the sum of the remaining resetting force and the friction between the sole of the boot 22 in the low friction lining 35 is substantially less than the release force. In this manner the effects of friction between the sole 22 and the pedal 34' in the critical region of the lateral release are negligibly small.

In accordance with the invention an emergency treading surface or footplate 39 is provided behind the pedal 34', the surface of which lies somewhat lower than the surface of the low friction lining 35. Should the pedal 34' spring out of its guide 54 and be lost then the emergency treading surface 39 is available to support the sole of the ski boot 22. The small difference in height between the lining 35 and the emergency treading surface 39 is compensated for without problem by the pliers action of the jaw unit of the invention.

The guide 54 preferably consists of sheet metal whereby a low friction value is obtained between the pedal 34' of plastic and the guide 54. In the event that the pedal 34' jams in the guide 54 through freezing or corrosion, or also through mechanical damage to the guide 54 the resistance to lateral movement of the sole 22 still remains low because the low friction lining 35 is provided.

The lateral range of movement of the pedal to one side amounts to approximately 15 mm. The resistance to a further sideways movement of the sole 22 is then determined by the friction between the sole 22 and the lining 35.

We claim

1. A laterally releasable jaw unit, such as a toe unit of a safety ski binding for holding one end of a ski boot to a ski surface, the binding also having a jaw which holds the other end of the ski boot, said jaw unit comprising: a binding housing, a sole clamp having two lateral limbs and a hold-down clamp disposed on the housing adjacent the ski boot, and a release spring disposed in the binding housing substantially in longitudinal direction of the ski; said release spring having a first end acting on the binding housing and a second end exerting a force on the sole clamp, the force having a substantial component in the longitudinal direction of the ski away from the ski boot; tilting surfaces being arranged at a side of the binding housing facing the ski boot on both sides of a vertical central longitudinal plane, said tilting surfaces having mutually parallel, straight tilting axes standing substantially upright from the ski surface, and complementary tilting counter-surfaces on the side of the sole clamp facing away from the ski boot and acting on the tilting surfaces under the action of a release force in such a way that with excessive lateral forces on the ski boot the sole clamp pivots outwardly against the force of the release spring and releases the ski boot, said release spring exerting a slightly downwardly directed force on the sole clamp, an angle being present between the line of action of the release spring and branches of the tilt axes lying beneath the line of action, the angle being smaller than 90° by an amount such that a force component thereof which acts downwardly on the sole clamp is sufficient to press the sole clamp downwardly along the tilting axes until the hold-down clamp presses against an upper side of a sole of the ski boot at least during vibrations which occur during skiing.

2. A jaw unit in accordance with claim 1, wherein the angle is realised by the line of action being directed obliquely downward away from the ski boot.

3. A jaw unit in accordance with claim 1, wherein the angle is realised by an inclination of the tilting axes in such a way that upper regions thereof are closer to the ski boot than if the tilting axes did extend perpendicularly to the ski surface.

4. A jaw unit in accordance with claim 1, wherein the angle lies in the range of from 70° to 80°.

5. A jaw unit in accordance with claim 1, wherein the release spring is a compression spring arranged between the binding housing and the sole clamp, said spring having a first end braced against an abutment fixed relative to the binding housing and a second end attached to a draw bar.

6. A jaw unit in accordance with claim 5, wherein the draw bar is secured to an abutment which accommodates the second end of the spring.

7. A jaw unit in accordance with claim 6, wherein the draw bar consists of two parts which are axially screwed together, one part being rotationally fixedly mounted on the sole clamp and the other part being rotatably mounted to the abutment and being accessible from the outside for the purpose of rotary actuation.

8. A jaw unit in accordance with claim 5, wherein an indicator projection extends from the second end of the spring substantially parallel to the line of action, beneath a window at the binding housing provided with a scale indicating release hardness of the spring.

9. A jaw unit in accordance with claim 5, wherein the draw bar consists of two parts which are axially screwed together, one part being rotationally fixedly mounted on the sole clamp and the other part being rotatably mounted at the second end of the spring and being accessible from the outside for the purpose of rotary actuation.

10. A jaw unit in accordance with claim 9, wherein said one part is a draw rod acting on an inclined surface of the pivot shaft which extends perpendicular to the axis of the draw bar.

11. A jaw unit in accordance with claim 1, wherein the release spring acts on a central pivot shaft which extends parallel to the tilting axes and is non-displaceable in the direction of the pivot shaft, but is pivotable relative to the sole clamp about the pivot shaft.

12. A jaw unit in accordance with claim 1, wherein the sole clamp is divided into two halves symmetrically to the vertical central longitudinal plane, each half being respectively rotatably connected with the pivot shaft via vertically displaced projections which cross the central longitudinal plane.

13. A jaw unit in accordance with claim 1, comprising a vertical tilting abutment located on the binding housing above the line of action of the release spring and cooperating with a vertical tilting counter-surface on the sole clamp in such a way that on occurrence of a pre-determined vertical force acting from the sole of the ski boot on the hold-down clamp the sole clamp first slides upwardly along the tilting axes until the vertical tilting counter-surfaces abut against a vertical tilting abutment; and on further increase of the vertical force to a value which is dangerous for the skier the sole clamp can pivot upwardly to release the ski boot about the vertical tilting abutment.

14. A jaw unit in accordance with claim 13, wherein at least two vertical tilting counter-surfaces are provided and are selectively positionable at different levels below the vertical tilting abutment.

15. A jaw unit in accordance with claim 14, wherein a first, fixed vertical tilting counter-surface is provided on the sole clamp and a second vertical tilting counter-surface is provided on a slider.

16. A jaw unit in accordance with claim 15, wherein the slider is horizontally displaceable.

17. A jaw unit in accordance with claim 16, wherein the slider is slidable over the first vertical tilting counter-surface.

18. A jaw unit in accordance with claim 1, comprising a pedal beneath the sole of the ski boot near to the sole clamp and carrying a low friction layer.

19. A jaw unit in accordance with claim 18, wherein the pedal is vertically movable and acts via a force deflecting transmission on the sole clamp vertically from below in such a way that when the skier is in a forward position the sole clamp is pressed upwardly along the tilting axes so far that the holdown down clamp substantially no longer presses on the upper side of the sole of the ski boot.

20. A jaw unit in accordance with claim 18, wherein the pedal is resiliently and elastically laterally restrictedly displaceable, a resetting force exerted on the sole clamp during deflection up to a maximum displacement path of the pedal being reduced sufficiently so that the sum of the resetting force and friction force between the sole and the pedal is substantially less than the release force of the spring.

21. A jaw unit in accordance with claim 20, comprising an emergency treading surface of low friction material in the vicinity of, and somewhat downwardly of, the pedal.

22. A jaw unit in accordance with claim 1, wherein the sole clamp has at least two front support positions located laterally of the central longitudinal plane, and at least two support locations which support an obliquely forwardly extending region of the sole at the side obliquely from the front.

* * * * *